US010283050B2

(12) United States Patent
Yin

(10) Patent No.: US 10,283,050 B2
(45) Date of Patent: May 7, 2019

(54) DRIVING POWER SUPPLY, DISPLAY DRIVING CIRCUIT AND ORGANIC LIGHT EMITTING DIODE DISPLAY

(71) Applicant: BOE TECHNOLOGY GROUP CO., LTD., Beijing (CN)

(72) Inventor: Xinshe Yin, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 49 days.

(21) Appl. No.: 14/784,294

(22) PCT Filed: Apr. 17, 2015

(86) PCT No.: PCT/CN2015/076833
§ 371 (c)(1),
(2) Date: Oct. 14, 2015

(87) PCT Pub. No.: WO2016/078314
PCT Pub. Date: May 26, 2016

(65) Prior Publication Data

US 2016/0314741 A1 Oct. 27, 2016

(30) Foreign Application Priority Data

Nov. 19, 2014 (CN) ..... 2014 1 0664662

(51) Int. Cl.
*G09G 3/3258* (2016.01)
*G09G 3/3291* (2016.01)
*G09G 3/3225* (2016.01)

(52) U.S. Cl.
CPC ..... *G09G 3/3258* (2013.01); *G09G 3/3225* (2013.01); *G09G 3/3291* (2013.01);
(Continued)

(58) Field of Classification Search
CPC ..... G09G 3/3258; G09G 3/3291; G09G 2330/023; G09G 2300/0809
(Continued)

(56) References Cited

U.S. PATENT DOCUMENTS 5,617,015 A 4/1997 Goder et al.
2005/0116922 A1 6/2005 Kim
(Continued)

FOREIGN PATENT DOCUMENTS

CN 1641739 A 7/2005
CN 1831922 A 9/2006
(Continued)

OTHER PUBLICATIONS

Notification of the First Office Action dated Mar. 3, 2016 corresponding to Chinese Application No. 201410664662.9.
(Continued)

*Primary Examiner* — Vinh T Lam
(74) *Attorney, Agent, or Firm* — Nath, Goldberg & Meyer; Joshua B. Goldberg

(57) ABSTRACT

The present invention discloses a driving power supply, a display driving circuit and an organic light emitting diode display. The driving power supply comprises a boost module and a voltage adjusting module connected to the boost module; the boost module is used for boosting an initial voltage input from an initial voltage input terminal of the driving power supply to generate a reference voltage and outputting the reference voltage to the voltage adjusting module; the voltage adjusting module is used for adjusting magnitude of the reference voltage according to colors of pixel units to be driven to generate a plurality of driving voltages, respectively, and the driving voltages corresponding to pixel units of different colors are different.

18 Claims, 6 Drawing Sheets

(52) U.S. Cl.
CPC ..... *G09G 2300/0809* (2013.01); *G09G 2320/0242* (2013.01); *G09G 2330/02* (2013.01); *G09G 2330/023* (2013.01); *G09G 2330/028* (2013.01)

(58) Field of Classification Search
USPC ..... 345/690, 699, 210–215, 39, 44–53, 63, 345/69–72, 76–80, 82–95, 98–101; 315/91, 117–118, 141–148, 161–176, 315/201–208, 210–217, 246–272, 315/276–287, 302–305, 313; 323/259, 323/344
See application file for complete search history.

(56) References Cited

U.S. PATENT DOCUMENTS

2006/0082529 A1* 4/2006 Oyama ..... G09G 3/3406 345/82
2006/0187181 A1 8/2006 Kim
2006/0202631 A1* 9/2006 Hayafuji ..... G09G 3/3258 315/169.2
2006/0202913 A1* 9/2006 Hayafuji ..... G09G 3/3233 345/44
2007/0080905 A1* 4/2007 Takahara ..... G09G 3/3233 345/76
2007/0132674 A1* 6/2007 Tsuge ..... G09G 3/2014 345/77
2007/0176862 A1* 8/2007 Kurt ..... G09G 3/2092 345/82
2008/0088385 A1 4/2008 Gizara
2008/0303767 A1* 12/2008 Ludden ..... G09G 3/3688 345/89
2008/0315780 A1* 12/2008 Lee ..... G09G 3/3406 315/210
2009/0109142 A1* 4/2009 Takahara ..... G09G 3/006 345/76
2009/0122046 A1* 5/2009 Minami ..... G09G 3/3233 345/211
2009/0231052 A1 9/2009 Li
2010/0117937 A1 5/2010 Kim et al.
2011/0069094 A1* 3/2011 Knapp ..... G09G 3/2003 345/690
2011/0084620 A1* 4/2011 Lee ..... H05B 33/0815 315/186
2012/0326691 A1 12/2012 Kuan et al.
2014/0184481 A1* 7/2014 Kim ..... G09G 3/3233 345/82
2014/0293038 A1* 10/2014 Delmonico ..... H04N 5/2256 348/82
2014/0313242 A1* 10/2014 Kaplan ..... G09G 3/3208 345/694
2014/0320546 A1* 10/2014 Lim ..... G09G 3/3291 345/690
2015/0091463 A1* 4/2015 Jin ..... H05B 33/0809 315/201
2015/0091950 A1* 4/2015 Park ..... G09G 3/3291 345/690
2015/0130867 A1* 5/2015 Park ..... G09G 3/2092 345/694
2015/0161941 A1* 6/2015 Lim ..... G09G 3/3208 345/691
2015/0302787 A1* 10/2015 Yin ..... G09G 3/3233 345/80
2016/0196781 A1* 7/2016 Tanaka ..... G09G 3/3648 345/691
2016/0301027 A1* 10/2016 Wang ..... H01L 25/048

FOREIGN PATENT DOCUMENTS

CN 101425284 A 5/2009
CN 101739945 A 6/2010
CN 101808443 A 8/2010
CN 101925230 A 12/2010
CN 201829173 * 2/2011 ..... G09G 3/20
CN 201829173 U 5/2011
CN 102421230 A 4/2012
CN 202587472 U 12/2012
CN 103971634 A 8/2014
CN 203773913 U 8/2014
CN 104318903 A 1/2015
CN 202404378 U 3/2015
CN 204204378 U 3/2015
JP 10268266 A 10/1998
JP 2006259239 A 9/2006
KR 10-2010-0053345 A 5/2010
KR 10-2014-0124610 A 10/2014
WO 02093540 A1 11/2002

OTHER PUBLICATIONS

International Search Report dated Aug. 5, 2015 corresponding to International application No. PCT/CN2015/076833.
Written Opinion of the International Searching Authority dated Aug. 5, 2015 corresponding to International application No. PCT/CN2015/076833.
2nd office action issued in corresponding Chinese application No. 201410664662.9 dated Aug. 26, 2016.
1st office action issued in corresponding Korean application No. 10-2015-7030513 dated Oct. 23, 2016.
Fourth Office Action dated Jul. 5, 2017 in corresponding Chinese patent Application No. 201410664662.9.
Extended European Search Report dated May 25, 2018 corresponding to application No. 15767406.0-1210.
Notification of Reasons for Refusal dated Dec. 3, 2018 corresponding to Japanese application No. 2017545994.

* cited by examiner

DRIVING POWER SUPPLY, DISPLAY DRIVING CIRCUIT AND ORGANIC LIGHT EMITTING DIODE DISPLAY

This is a National Phase Application filed under 35 U.S.C. 371 as a national stage of PCT/CN 2015/076833,filed Apr. 17, 2015,an application claiming the benefit of Chinese Application No. 201410664662.9, filed Nov. 19, 2014, the content of each of which is hereby incorporated by reference in its entirety.

FIELD OF THE INVENTION

The present invention relates to the field of display technology, and particularly relates to a driving power supply, a display driving circuit and an organic light emitting diode display.

BACKGROUND OF THE INVENTION

Compared to a thin film transistor liquid crystal display (TFT-LCD) which is the mainstream display technique in nowadays, an organic light emitting diode (OLED) has advantages such as wide viewing angle, high brightness, high contrast, low power consumption, thinner thickness and lighter weight, and becomes the focus of attention in the field of flat panel display technology.

Driving methods of the organic light emitting diode displays are classified into two types: passive matrix type and active matrix type. Compared to a passive matrix type organic light emitting diode display, an active matrix type organic light emitting diode display has advantages such as ability to display large amount of information, low power consumption, long service life of devices, high contrast of picture and the like.

In an organic light emitting diode display, a plurality of pixel unit driving circuits are provided. Each of the pixel unit driving circuits is connected with a driving power supply, thus together forming a display driving circuit for display.

FIG. 1 is a schematic diagram of a pixel unit driving circuit of an active matrix type organic light emitting diode display in the prior art, and as shown in FIG. 1, the pixel unit driving circuit includes: a switching transistor M1, a driving transistor M2, a storage capacitor C and a light emitting device OLED, wherein, a gate of the driving transistor M2 is connected to a drain of the switching transistor M1, a source of the driving transistor M2 is connected to a driving power supply 1 (sources of driving transistors M2 of a plurality of pixel unit driving circuits are connected to the same driving power supply 1), a drain of the driving transistor M2 is connected to the light emitting device OLED, and when the switching transistor M1 is turned on under the control of a scanning signal Vscan, a data voltage Vdata is transferred to the gate of the driving transistor M2 through the switching transistor M1. In the meanwhile, the driving power supply 1 supplies a driving voltage VDD to the source of the driving transistor M2. Gate-source voltage of the driving transistor M2 is Vgs, which determines magnitude of a driving current flowing through the driving transistor M2, and the driving current is used for driving the light emitting device OLED to generate stable light. The function of the storage capacitor C is to maintain the stability of gate voltage of the driving transistor M2 during one frame time.

When the light emitting device OLED emits light, a voltage drop VD1 generated by the light emitting device OLED, a voltage drop VDS on a load current path (drain-source path) of the driving transistor M2 and the driving voltage VDD generated by the driving power supply 1 satisfy the following relationship: VDD=VDS+VD1.

FIG. 2 is a schematic circuit diagram of the driving power supply in FIG. 1, and as shown in FIG. 2, the driving power supply includes: a boost module, one terminal of which is connected to an initial voltage input terminal and the other terminal of which is connected to the driving transistor M2 in the pixel unit driving circuit. The boost module is used for boosting an initial voltage VCC input from the initial voltage input terminal to obtain the driving voltage VDD, and outputting the driving voltage VDD to the driving transistor M2. The boost module includes: a boost chip 2, an energy-storage inductor L, a first switching tube T1, a Schottky diode D, a first resistor RA, a second resistor RB and a first filter capacitor C1, wherein, one terminal of the energy-storage inductor L is connected to the initial voltage input terminal, the other terminal of the energy-storage inductor L is connected to a first terminal of the Schottky diode D and a second electrode of the first switching tube T1, an input terminal of the boost chip 2 is connected to the initial voltage input terminal, a feedback terminal of the boost chip 2 is connected to the first resistor RA and the second resistor RB, a control terminal of the boost chip 2 is connected to a gate of the first switching tube T1, the first terminal of the Schottky diode D is connected to the second electrode of the first switching tube T1, and a second terminal of the Schottky diode D is connected to the first filter capacitor C1.

Boosting voltage can be achieved by controlling a field effect transistor (not shown) integrated inside the boost chip 2 to be turned on or off. Specifically, when the field effect transistor integrated inside the boost chip 2 is turned on, the Schottky diode D is turned off reversely, current in the energy-storage inductor L increases constantly, and the energy-storage inductor L stores energy; when the field effect transistor integrated inside the boost chip 2 is turned off, the energy-storage inductor L outputs through the Schottky diode D, thus accomplishing energy transfer. The feedback terminal of the boost chip 2 controls turn-on time and turn-off time of the integrated field effect transistor according to voltage across the second resistor RB, thereby controlling magnitude of the driving voltage VDD output from the boost module.

FIG. 3 is a diagram illustrating the driving principle of an active matrix type organic light emitting diode display in the prior art, and FIG. 4 is graph illustrating relationship between brightnesses of red, green and blue organic electroluminescent devices and voltage drops thereof As shown in FIGS. 3 and 4, the organic light emitting diode display includes pixel units of three different colors: red (R), green (G) and blue (B), wherein, a red organic electroluminescent device OLEDR is provided inside a red pixel unit, a green organic electroluminescent device OLEDG is provided inside a green pixel unit, a blue organic electroluminescent device OLEDB is provided inside a blue pixel unit, and all of the pixel units are driven by the same driving voltage VDD (magnitude of the driving voltage VDD satisfy the condition that the blue organic electroluminescent device OLEDB can be driven when reaching its maximum brightness).

Referring to FIG. 4, since light emitting layers of the organic electroluminescent devices of three different colors are made of different semiconductor materials, the organic electroluminescent devices of three different colors generate different voltage drops when they have the same brightness. The voltage drop generated by the blue organic electroluminescent device OLEDB is the largest, the voltage drop generated by the red organic electroluminescent device OLEDR follows, and the voltage drop generated by the green organic electroluminescent device OLEDG is the smallest. Here, since all of the pixel units are driven by the same driving voltage VDD, gate-source voltages of the driving transistors inside the red and green pixel units will be large. However, loading large voltage on the driving transistor will not only heat the driving transistor and further impact service life of the driving transistor, but also result in large power consumption of the display driving circuit.

SUMMARY OF THE INVENTION

The present invention provides a driving power supply, a display driving circuit and an organic light emitting diode display, which are used for solving the technical problem that heating in the driving transistor is serious and power consumption of the display driving circuit is large, due to large voltage loaded across the driving transistor in the prior art.

In order to achieve the above object, the present invention provides a driving power supply, comprising a boost module and a voltage adjusting module connected to the boost module, wherein, the boost module is used for boosting an initial voltage input from an initial voltage input terminal of the driving power supply to generate a reference voltage and for outputting the reference voltage to the voltage adjusting module; and the voltage adjusting module is used for adjusting magnitude of the reference voltage according to colors of pixel units to be driven to generate a plurality of driving voltages, respectively, wherein, the driving voltages corresponding to pixel units of different colors are different.

Optionally, the driving power supply further comprises: a plurality of driving voltage output terminals for outputting the plurality of driving voltages, the driving voltage output terminals are connected to the voltage adjusting module, each driving voltage output terminal is used for driving the pixel units of one color, and different driving voltage output terminals output different driving voltages.

Optionally, the voltage adjusting module comprises: a pulse control module, second switching tubes and second filter capacitors, the number of the second switching tubes and the number of the second filter capacitors are equal to that of the driving voltage output terminals, the second switching tubes are in one-to-one correspondence with the driving voltage output terminals, and the second filter capacitors are in one-to-one correspondence with the driving voltage output terminals;

gates of the second switching tubes are connected to the pulse control module, first electrodes of the second switching tubes are connected to the boost module, second electrodes of the second switching tubes are connected to the corresponding driving voltage output terminals and first terminals of the second filter capacitors;

second terminals of the second filter capacitors are grounded; and the pulse control module is used for generating pulse control signals and sending them to the second switching tubes, respectively, and duty ratio of each pulse control signal equals to a ratio between the driving voltage output from the driving voltage output terminal connected to the second switching tube which receives said pulse control signal and the reference voltage.

Optionally, the pulse control module comprises: a pulse-adjusting control sub-module, a pulse generator, a pulse width modulation circuit and a level conversion circuit, and the pulse width modulation circuit is connected to all of the pulse-adjusting control sub-module, the pulse generator and the level conversion circuit;

the pulse-adjusting control sub-module is used for generating a plurality of pulse-adjusting control signals according to the reference voltage and the driving voltages to be generated by the voltage adjusting module;

the pulse generator is used for generating an initial pulse signal with a preset frequency;

the pulse width modulation circuit is used for performing pulse width modulation on the initial pulse signal according to the respective pulse-adjusting control signals, so as to generate a plurality of initial pulse control signals; and the level conversion circuit is used for performing level conversion on the initial pulse control signals so as to generate a plurality of pulse control signals, which are used for controlling on/off states of the second switching tubes, respectively.

Optionally, the pulse-adjusting control sub-module comprises: a storage device and a decoding circuit connected to both the storage device and the pulse width modulation circuit;

the storage device stores data information of the reference voltage and data information of the driving voltages to be generated by the voltage adjusting module; and the decoding circuit is used for performing a decoding process on the data information of the reference voltage and the data information of the driving voltages to be generated by the voltage adjusting module, so as to obtain voltage values of the reference voltage and the driving voltages to be generated by the voltage adjusting module, and the decoding circuit is further used for generating pulse-adjusting control signals according to ratios between the voltage values of the driving voltages to be generated by the voltage adjusting module and the voltage value of the reference voltage.

Optionally, the storage device is a read-only memory, which pre-stores data information of the driving voltages corresponding to the pixel units of different colors and the data information of the reference voltage.

Optionally, the storage device is a register, and the pulse-adjusting control sub-module further comprises: a signal receiver which is connected to the decoding circuit;

the signal receiver is used for receiving a timing control signal sent by a timing controller outside the driving power supply, and the timing control signal includes the data information of the reference voltage and the data information of the driving voltages to be generated by the voltage adjusting module; and the decoding circuit is further used for decoding the timing control signal to obtain the data information of the reference voltage and the data information of the driving voltages to be generated by the voltage adjusting module therein, and storing the decoded data information of the reference voltage and the decoded data information of the driving voltages to be generated by the voltage adjusting module into the register.

Optionally, the pulse-adjusting control sub-module comprises: a first level signal input terminal and groups of divider resistors whose number is the same as that of the driving voltage output terminals, each group of divider resistors comprises: a third resistor and a fourth resistor connected in series;

the first level signal input terminal is connected to first terminals of the third resistors, second terminals of the fourth resistors are grounded, second terminals of the third resistors and first terminals of the fourth resistors are connected to the pulse width modulation circuit;

the first level signal input terminal is used for generating a first initial level signal and outputting the first initial level signal to the groups of divider resistors;

the groups of divider resistors each are used for performing voltage dividing process on the first initial level signal to generate the pulse-adjusting control signals; and ratios between resistance values of the third resistors and resistance values of the fourth resistors in different groups of divider resistors are different.

Optionally, the pulse-adjusting control sub-module comprises: a second level signal input terminal and fifth resistors whose number is the same as that of the driving voltage output terminals, the second level signal input terminal is connected to first terminals of the fifth resistors, and second terminals of the fifth resistors are connected to the pulse width modulation circuit;

the second level signal input terminal is used for generating a second initial level signal and outputting the second initial level signal to the fifth resistors;

the fifth resistors each are used for performing voltage reduction on the second initial level signal to generate the pulse-adjusting control signals; and resistance values of the fifth resistors are different from each other.

Optionally, the pixel units include: red pixel units, green pixel units and blue pixel units, and the number of the driving voltage output terminals is three.

Optionally, the pulse control signals include: red pulse control signal, green pulse control signal and blue pulse control signal;

phase differences between a rising edge of any one of the red pulse control signal, the green pulse control signal and the blue pulse control signal and rising edges of the other two pulse control signals are both 120 degrees; or, phase differences between a falling edge of any one of the red pulse control signal, the green pulse control signal and the blue pulse control signal and falling edges of the other two pulse control signals are both 120 degrees.

Optionally, the pulse control module is a single chip microcomputer.

Optionally, the voltage adjusting module comprises: linear voltage regulators and third filter capacitors, the number of the linear voltage regulators and the number of the third filter capacitors are the same as that of the driving voltage output terminals, the linear voltage regulators are in one-to-one correspondence with the driving voltage output terminals, and the third filter capacitors are in one-to-one correspondence with the driving voltage output terminals;

input terminals of the linear voltage regulators are connected to the boost module, and output terminals of the linear voltage regulators are connected to the driving voltage output terminals and first terminals of the third filter capacitors;

second terminals of the third filter capacitors are grounded;

the linear regulators each are used for performing voltage reduction on the reference voltage to generate the driving voltages; and different linear voltage regulators have different voltage reduction extents.

In order to achieve the above object, the present invention further provides a display driving circuit, comprising a driving power supply which is the above-described power supply.

In order to achieve the above object, the present invention further provides an organic light emitting diode display, comprising a display driving circuit which is the above-described display driving circuit.

The present invention has the following beneficial effects:

the present invention provides a driving power supply, a display driving circuit and an organic light emitting diode display, wherein, the driving power supply can provide corresponding driving voltage according to colors of the pixel units to be driven, so that the voltage across the driving transistor in the driving circuit of the pixel unit is reduced as compared to the voltage across the driving transistor in the prior art, thereby reducing power consumption of the driving transistor and further reducing power consumption of the display driving circuit as a whole. Besides, heat generated by the driving transistor is reduced, and reliability of the transistor is improved.

DETAILED DESCRIPTION OF THE EMBODIMENTS

To enable those skilled in the art to better understand the technical solutions of the present invention, a driving power supply, a display driving circuit and an organic light emitting diode display provided by the present invention will be described in detail below in conjunction with the accompanying drawings.

Embodiment 1

Figure 1:
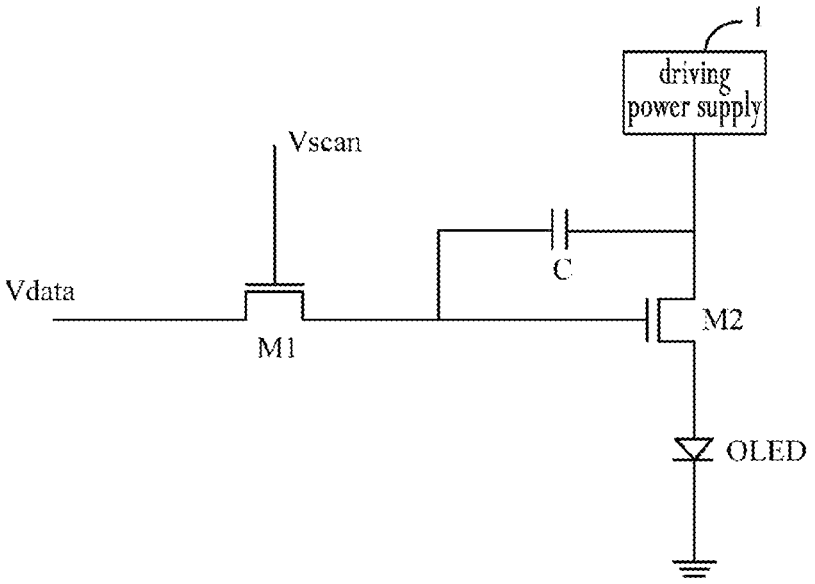
FIG. 1 is a schematic diagram of a pixel unit driving circuit of an active matrix type organic light emitting diode display in the prior art.
Figure 2:
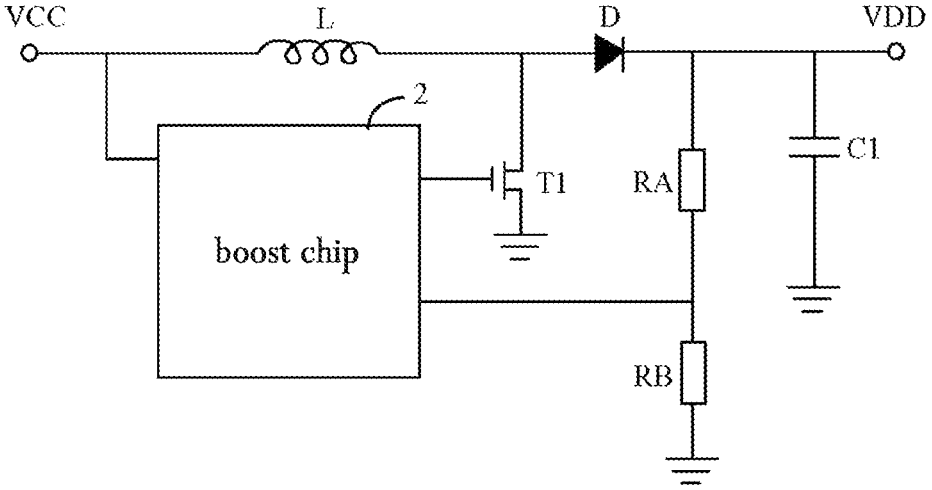
FIG. 2 is a schematic circuit diagram of the driving power supply in FIG. 1.
Figure 3:
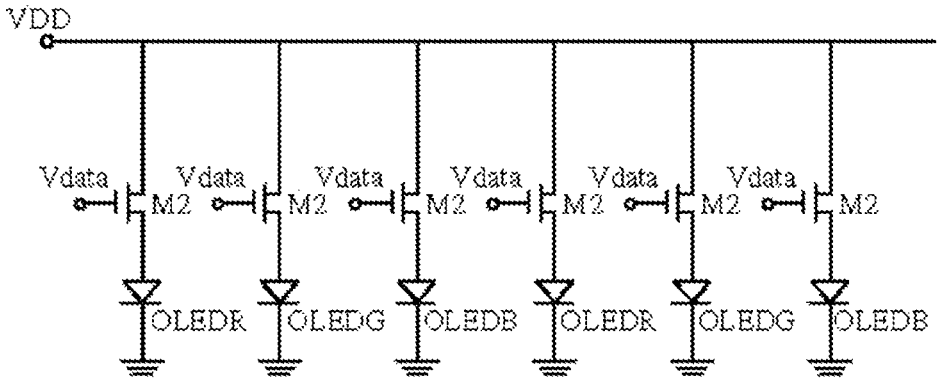
FIG. 3 is a diagram illustrating the driving principle of an active matrix type organic light emitting diode display in the prior art.
Figure 4:
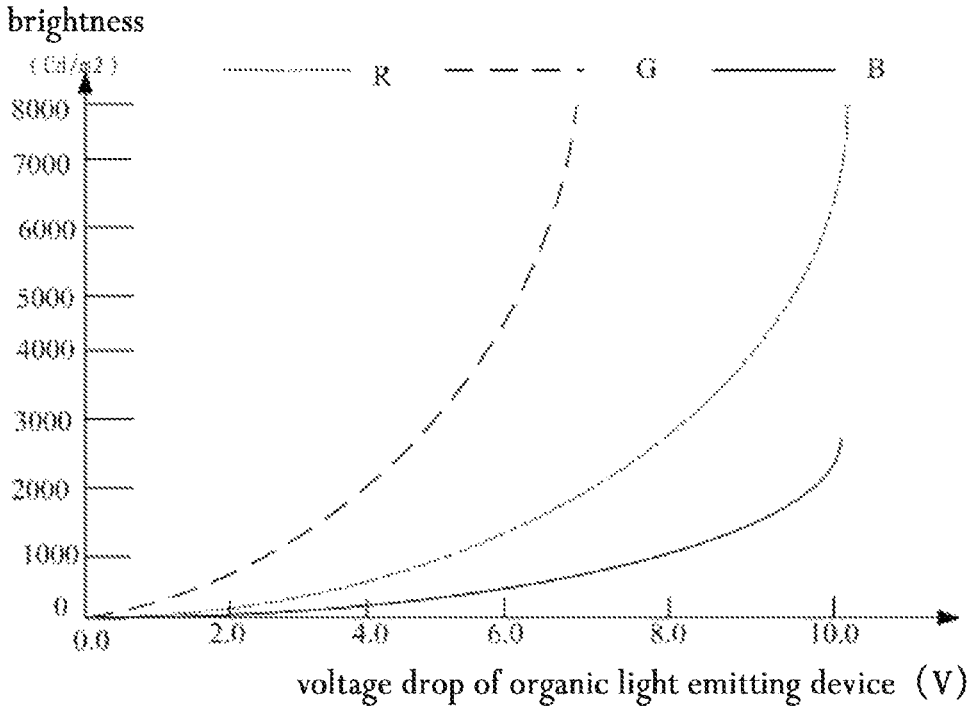
FIG. 4 is graph illustrating relationship between brightnesses of red, green and blue organic electroluminescent devices and voltage drops thereof.
Figure 5:
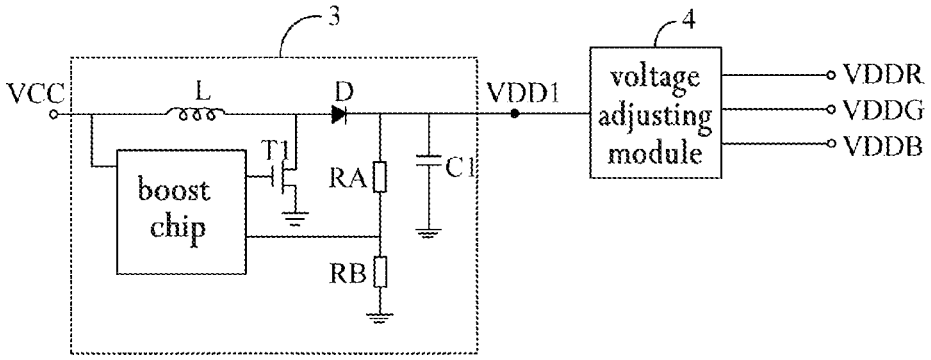
FIG. 5 is a schematic circuit diagram of a driving power supply provided by Embodiment 1 of the present invention.

FIG. 5 is a schematic circuit diagram of a driving power supply provided by Embodiment 1 of the present invention, and as shown in FIG. 5, the driving power supply includes:

a boost module 3 and a voltage adjusting module 4, wherein, the voltage adjusting module 4 is connected to the boost module 3, the boost module 3 is used for boosting an initial voltage VCC input from an initial voltage input terminal of the driving power supply to generate a reference voltage VDD1 and for outputting the reference voltage VDD1 to the voltage adjusting module 4, and the voltage adjusting module 4 is used for adjusting magnitude of the reference voltage VDD1 according to colors of pixel units to be driven, so as to generate a plurality of driving voltages respectively. Here, driving voltages corresponding to pixel units of different colors are different.

It should be noted that, specific structure and boosting principle of the boost module 3 belong to the prior art, and are not described repeatedly herein. The reference voltage VDD1 in the present embodiment is equal in magnitude to the driving voltage VDD in the prior art.

The driving power supply provided by the present embodiment can generate corresponding driving voltage according to colors of the pixel units to be driven, and thus pixel units of different colors are driven by different driving voltages.

Optionally, the driving power supply further includes: a plurality of driving voltage output terminals for outputting the driving voltages. Each of the driving voltage output terminals is connected to the voltage adjusting module 4 and is used for driving pixel units of one color, and different driving voltage output terminals output different driving voltages.

The present embodiment is described by taking the case that the pixel units include red, green and blue pixel units as an example. Accordingly, there are three driving voltage output terminals in the driving power supply, and it is assumed that the three driving voltage output terminals are red driving voltage output terminal, green driving voltage output terminal and blue driving voltage output terminal, respectively. The red driving voltage output terminal is connected to driving transistors in the driving circuits of a plurality of red pixel units, the green driving voltage output terminal is connected to driving transistors in the driving circuits of a plurality of green pixel units, and the blue driving voltage output terminal is connected to driving transistors in the driving circuits of a plurality of blue pixel units. Here, the driving voltage output from the red driving voltage output terminal is red driving voltage VDDR, the driving voltage output from the green driving voltage output terminal is green driving voltage VDDG, and the driving voltage output from the blue driving voltage output terminal is blue driving voltage VDDB. The red driving voltage VDDR, the green driving voltage VDDG and the blue driving voltage VDDB are all smaller than or equal to the reference voltage VDD1, and the red driving voltage VDDR, the green driving voltage VDDG and the blue driving voltage VDDB are different in magnitude. In the present embodiment, the red driving voltage VDDR may be used for driving in the driving circuit of the red pixel unit, the green driving voltage VDDG may be used for driving in the driving circuit of the green pixel unit, and the blue driving voltage VDDB may be used for driving in the driving circuit of the blue pixel unit. In this way, compared to the prior art, the driving power supply provided by the present embodiment can effectively lower the gate-source voltages of driving transistors in the driving circuits of the red pixel unit and the green pixel unit, thereby avoiding heating in the driving transistors and reducing power consumption of the driving transistors as well. As for the whole display driving circuit, since power consumption of a part of the driving transistors is reduced, power consumption of the display driving circuit as a whole can be reduced.

Embodiment 1 of the present invention provides a driving power source, which can provide corresponding driving voltage according to colors of the pixel units to be driven, and further reduce the voltage across the driving transistor in the driving circuit of the pixel unit as compared to the voltage across the driving transistor in the prior art, thereby reducing power consumption of the driving transistor and further reducing power consumption of the display driving circuit as a whole.

Embodiment 2

Figure 6:
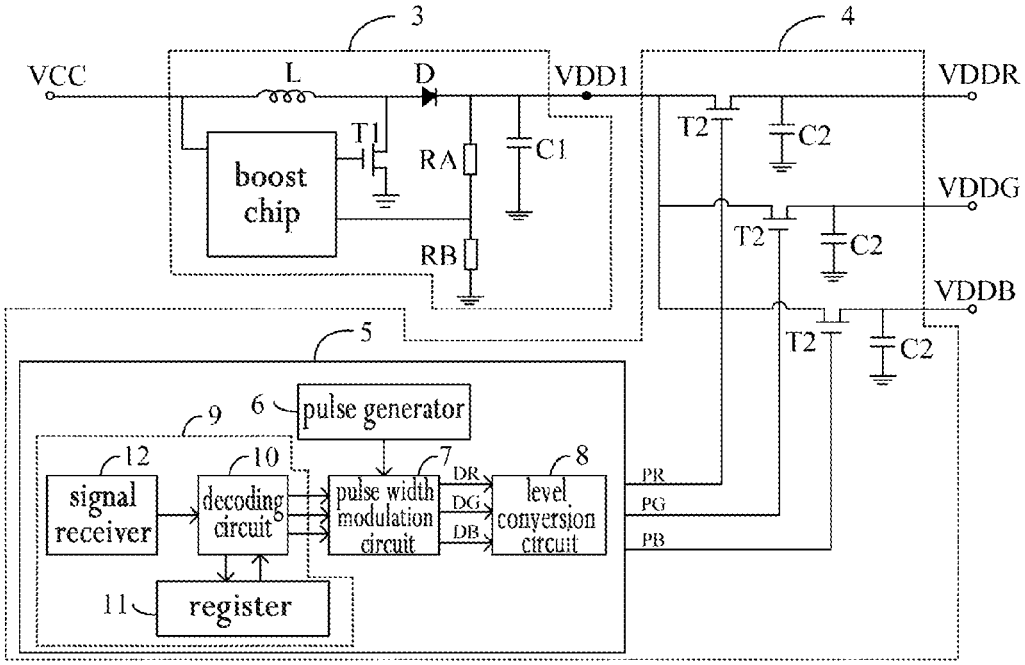
FIG. 6 is a schematic circuit diagram of a driving power supply provided by Embodiment 2 of the present invention.

FIG. 6 is a schematic circuit diagram of a driving power supply provided by Embodiment 2 of the present invention, as shown in FIG. 6, the driving power supply includes: a boost module 3 and a voltage adjusting module 4, and connection and functions of the boost module 3 and the voltage adjusting module 4 may refer to Embodiment 1. The present embodiment provide one specific structure of the driving power supply in the above Embodiment 1, and will be described by taking the case that there are three driving voltage output terminals in the driving power supply as an example as well. In the present embodiment, the voltage adjusting module 4 includes: a pulse control module 5, second switching tubes T2 and second filter capacitors C2, and the number of second switching tubes T2 and the number of second filter capacitors C2 are equal to that of the driving voltage output terminals. The second switching tubes T2 are in one-to-one correspondence with the driving voltage output terminals, and the second filter capacitors C2 are in one-to-one correspondence with the driving voltage output terminals, that is, each driving voltage output terminal is connected to one pair of second switching tube T2 and second filter capacitor C2. Gates of the second switching tubes T2 are connected to the pulse control module 5, first electrodes of the second switching tubes T2 are connected to the boost module 3, second electrodes of the second switching tubes T2 are connected to the corresponding driving voltage output terminals and first terminals of the second filter capacitors C2, and second terminals of the second filter capacitors C2 are grounded. The pulse control module 5 is used for generating pulse control signals and sending the pulse control signals to the second switching tubes T2, respectively. Duty ratio of each pulse control signal equals to a ratio between the driving voltage output from the driving voltage output terminal connected to the second switching tube T2 which receives the pulse control signal and the reference voltage VDD1.

Here, the first electrode of the second switching tube T2 refers to the source of the second switching tube T2, and the second electrode of the second switching tube T2 refers to the drain of the second switching tube T2.

Specifically, the pulse control module 5 may include: a pulse-adjusting control sub-module 9, a pulse generator 6, a pulse width modulation circuit 7 and a level conversion circuit 8. The pulse width modulation circuit 7 is connected to the pulse-adjusting control sub-module 9, the pulse generator 6 and the level conversion circuit 8, and the pulse-adjusting control sub-module 9 is used for generating a plurality of pulse-adjusting control signals according to the reference voltage and the driving voltages to be generated by the voltage adjusting module 4. The pulse generator 6 is used for generating an initial pulse signal; the pulse width modulation circuit 7 is used for performing pulse width modulation on the initial pulse signal according to the respective pulse-adjusting control signals, so as to generate a plurality of initial pulse control signals DR, DG, and DB; and the level conversion circuit 8 is used for performing level conversion on the initial pulse control signals so as to generate a plurality of pulse control signals PR, PG, and PB, which are used for controlling on/off states of the second switching tubes T2, respectively.

Further, the pulse-adjusting control sub-module 9 may include: a storage device and a decoding circuit 10, and the decoding circuit 10 is connected to the storage device and the pulse width modulation circuit 7. The storage device stores data information of the reference voltage and data information of the driving voltages to be generated by the voltage adjusting module 4; the decoding circuit 10 is used for performing a decoding process on the data information of the reference voltage and the data information of the driving voltages to be generated, so as to obtain voltage values of the reference voltage and the driving voltages to be generated, and the decoding circuit 10 is further used for generating pulse-adjusting control signals according to ratios between the voltage values of the driving voltages to be generated and the voltage value of the reference voltage.

Further, the storage device may be a register 11, and the pulse-adjusting control sub-module 9 may further include: a signal receiver 12 which is connected to the decoding circuit 10 and is used for receiving a timing control signal sent by a timing controller outside the driving power supply. The timing controller sends the timing control signal to the signal receiver 12 through SPI interface or I2C bus or S-wire bus, and the timing control signal includes data information of the reference voltage and data information of the driving voltages to be generated by the voltage adjusting module 4. The decoding circuit 10 is further used for decoding the timing control signal to obtain the data information of the reference voltage and the data information of the driving voltages to be generated therein, and storing the decoded data information of the reference voltage and the decoded data information of the driving voltages to be generated into the register 11.

Working principle of the driving power supply provided by the present embodiment will be described in detail below in conjunction with the accompanying drawings.

Referring to FIG. 6, firstly, the signal receiver 12 receives the timing control signal sent by the timing controller and transmits the received timing control signal to the decoding circuit 10, and the decoding circuit 10 decodes the timing control signal to obtain the data information of the reference voltage and the data information of the driving voltages corresponding to the pixel units to be driven (i.e., data information of the driving voltages to be generated by the voltage adjusting module 4) therein, and stores them in the register 11. Subsequently, the decoding circuit 10 decodes the data information of the reference voltage and the data information of the driving voltages to be generated, which are stored in the register 11, so as to obtain voltage values of the reference voltage and the driving voltages to be generated, and then generates a plurality of pulse-adjusting control signals according to ratios between the respective decoded voltage values of the driving voltages to be generated and the reference voltage, and transmits the pulse-adjusting control signals to the pulse width modulation circuit 7; in the meanwhile, the pulse generator 6 generates an initial pulse signal with a preset frequency and transmits the initial pulse signal to the pulse width modulation circuit 7. Afterwards, the pulse width modulation circuit 7 perform pulse width modulation on the initial pulse signal according to the respective pulse-adjusting control signals generated by the decoding circuit 10, respectively, so as to generate a plurality of initial pulse control signals (voltages thereof are far less than the reference voltage VDD1), and each initial pulse control signal has a duty ratio equal to the ratio between the voltage value of the driving voltage corresponding thereto and the voltage value of the reference voltage. It should be noted that voltages of the initial pulse control signals are not strong enough to control on/off states of the second switching tubes T2 at this point. After that, the level conversion circuit 8 performs level conversion on the initial pulse control signals generated by the pulse width modulation circuit 7, respectively, so as to generate a plurality of pulse control signals (voltages thereof are generally close to the reference voltage VDD1), and the plurality of pulse control signals are respectively used for controlling on/off states of the second switching tubes T2. It should be noted that, level conversion raises voltages of the initial pulse control signals so that the obtained pulse control signals are strong enough to control on/off states of the second switching tubes T2, and duty ratios of the pulse control signals are the same as those of the initial pulse control signals. Finally, on/off states (specifically, ratios between on time and off time) of the second switching tubes T2 are controlled by the respective pulse control signals. Since on/off states of the second switching tubes T2 controlled by different pulse control signals are different, different voltages can be generated at the second electrodes of the second switching tubes T2, these voltages are then subjected to filtering process performed by the second filter capacitors C2, and stable driving voltages having different magnitudes are output at corresponding driving voltage output terminals. Here, the magnitude of the driving voltage is equal to a product of the reference voltage and the duty ratio of the pulse control signal.

It should be noted that, in the present embodiment, in the case that the second switching tube T2 is a N-type transistor, if the pulse control signal is at high level, the second switching tube T2 is turned on; if the pulse control signal is at low level, the second switching tube T2 is turned off In this case, the above-mentioned duty ratio of the pulse control signal specifically refers to a percentage, in one pulse period, of the time when the pulse control signal is at high level in the whole pulse period. In the case that the second switching tube T2 is a P-type transistor, if the pulse control signal is at high level, the second switching tube T2 is turned off; if the pulse control signal is at low level, the second switching tube T2 is turned on. In this case, the above-mentioned duty ratio of the pulse control signal specifically refers to a percentage, in one pulse period, of the time when the pulse control signal is at low level in the whole pulse period.

In the present embodiment, corresponding to red pixel units, green pixel units and blue pixel units, the signal receiver 12 receives three types of timing control signals, each of which corresponds to pixel units of one color. Three types of initial pulse control signals with different duty ratios can be output at the output terminal of the pulse width modulation circuit 7, and specifically are: red initial pulse control signal DR, green initial pulse control signal DG and blue initial pulse control signal DB. Here, duty ratio of the green initial pulse control signal DG is smaller than that of the red initial pulse control signal DR, and the duty ratio of the red initial pulse control signal DR is smaller than that of the blue initial pulse control signal DB. These three types of initial pulse control signals are converted into red pulse control signal PR, green pulse control signal PG and blue pulse control signal PB after being subjected to level conversion performed by the level conversion circuit 8, respectively.

Figure 7:
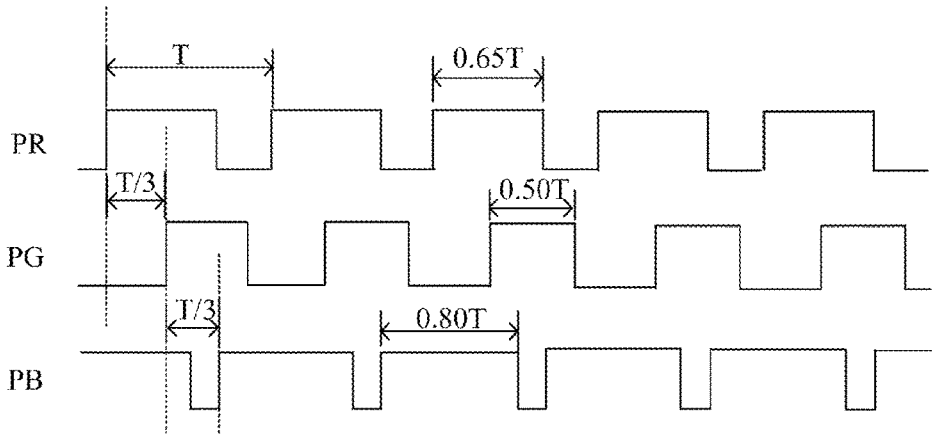
FIG. 7 is a timing diagram of red pulse control signal, green pulse control signal and blue pulse control signal in an embodiment of the present invention.

FIG. 7 is a timing diagram of red pulse control signal, green pulse control signal and blue pulse control signal in the embodiment of the present invention, as shown in FIG. 7, in the present embodiment, it is assumed that duty ratio of the red pulse control signal PR is 65%, duty ratio of the green pulse control signal PG is 50%, and duty ratio of the blue pulse control signal PB is 80%, and periods of the three pulse control signals are all T. When the second switching tube T2 is a N-type transistor (corresponding to the case as shown in FIG. 7), the time when the red pulse control signal PR is at high level in one period is 0.65T, the time when the green pulse control signal PG is at high level in one period is 0.50T, and the time when the blue pulse control signal PB is at high level in one period is 0.80T. Preferably, phase differences between a rising edge of any one of the red pulse control signal PR, the green pulse control signal PG and the blue pulse control signal PB and rising edges of the other two pulse control signals are both 120 degrees (one third of one pulse period, i.e., T/3). For example, as shown in FIG. 7, the rising edge of the green pulse control signal PG lags behind that of the red pulse control signal PR by 120 degrees, and the rising edge of the blue pulse control signal PB lags behind that of the green pulse control signal PG by 120 degrees (i.e., 120 degrees ahead of the rising edge of the red pulse control signal PR). It should be noted that, the case shown in FIG. 7 is just exemplary, instead of limiting the technical solutions of the present application. By configuring phase differences between the rising edge of any one of the red pulse control signal PR, the green pulse control signal PG and the blue pulse control signal PB and the rising edges of the other two pulse control signals to be 120 degrees, work efficiency of the whole power supply system can be effectively promoted.

Accordingly, when the second switching tube T2 is a P-type transistor, the time when the red pulse control signal PR is at low level in one period is 0.65T, the time when the green pulse control signal PG is at low level in one period is 0.50T, and the time when the blue pulse control signal PB is at low level in one period is 0.80T, phase differences between a falling edge of any one of the red pulse control signal PR, the green pulse control signal PG and the blue pulse control signal PB and falling edges of the other two pulse control signals are both 120 degrees (one third of one pulse period, i.e., T/3), and schematic drawings corresponding to this case are not given.

It should be noted that, structure of the pulse control module 5 in the present embodiment is not limited to that shown in FIG. 6.

Figure 8:
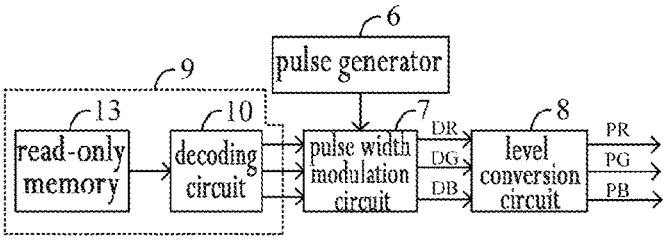
FIG. 8 is a schematic diagram of structure, as one optional implementation, of the pulse control module in FIG. 6.

FIG. 8 is a schematic diagram of structure, as another optional implementation, of the pulse control module 5, and as shown in FIG. 5, the pulse control module 5 includes: a pulse-adjusting control sub-module 9, a pulse generator 6, a pulse width modulation circuit 7 and a level conversion circuit 8. The pulse-adjusting control sub-module 9 includes: a read-only memory 13, in which data information of the driving voltages VDDR, VDDG and VDDB respectively corresponding to the red pixel units, green pixel units and blue pixel units and data information of the reference voltage VDD1 are pre-stored; and a decoding circuit 10, which can directly obtain corresponding data information and perform decoding process to generate corresponding pulse-adjusting control signals. The pulse width modulation circuit 7 generates red initial pulse control signal DR, green initial pulse control signal DG or blue initial pulse control signal DB based on the respective pulse-adjusting control signals.

Figure 9:
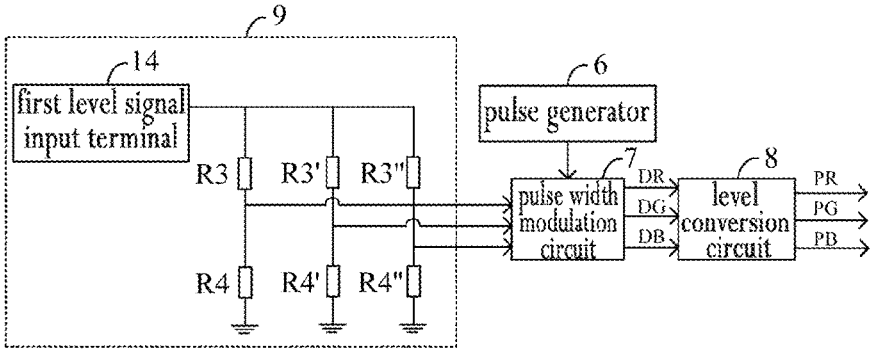
FIG. 9 is a schematic diagram of structure, as another optional implementation, of the pulse control module in FIG. 6.

FIG. 9 is a schematic diagram of structure, as another optional implementation, of the pulse control module 5, and as shown in FIG. 9, the pulse control module 5 includes: a pulse-adjusting control sub-module 9, a pulse generator 6, a pulse width modulation circuit 7 and a level conversion circuit 8. The pulse-adjusting control sub-module 9 includes: a first level signal input terminal 14 and groups of divider resistors, and the number of the groups is the same as that of the driving voltage output terminals. Each group of divider resistors includes one third resistor R3, R3' or R3" and one fourth resistor R4, R4' or R4" connected in series, the first level signal input terminal 14 is connected to first terminals of the third resistors R3, R3' and R3", second terminals of the fourth resistors R4, R4' and R4" are grounded, and second terminals of the third resistors R3, R3' and R3" and first terminals of the fourth resistors R4, R4' and R4" are connected to the pulse width modulation circuit 7; the first level signal input terminal 14 is used for generating a first initial level signal and outputting the first initial level signal to the groups of divider resistors at the same time, the groups of divider resistors each are used for performing voltage dividing process on the first initial level signal to generate a plurality of pulse-adjusting control signals. Ratios between resistance values of the third resistors and resistance values of the fourth resistors in different groups of divider resistors are different, and in this way, the generated pulse-adjusting control signals have different voltage values.

Corresponding to the pixel units of three different colors, the number of groups of divider resistors in FIG. 9 is three. Ratios between resistance values of the third resistors and resistance values of the fourth resistors in the respective groups of divider resistors are different from each other, that is, the ratio between R3 and R4, the ratio between R3' and R4', and the ratio between R3" and R4" are different from each other. Therefore, the three groups of divider resistors can output three pulse-adjusting control signals with different voltage values to the pulse width modulation circuit 7 in total, and based on the received pulse-adjusting control signals with different voltage values, the pulse width modulation circuit 7 can output three initial pulse control signals with different duty ratios in total, i.e., red initial pulse control signal DR, green initial pulse control signal DG and blue initial pulse control signal DB.

Figure 10:
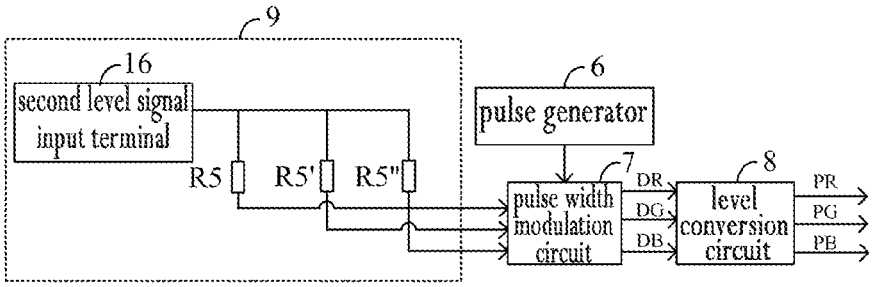
FIG. 10 is a schematic diagram of structure, as still another optional implementation, of the pulse control module in FIG. 6.

FIG. 10 is a schematic diagram of structure, as still another optional implementation, of the pulse control module 5, and as shown in FIG. 10, the pulse control module 5 includes a pulse-adjusting control sub-module 9, a pulse generator 6, a pulse width modulation circuit 7 and a level conversion circuit 8. The pulse-adjusting control sub-module 9 includes: a second level signal input terminal 16 and fifth resistors R5, R5' and R5" whose number is the same as that of the driving voltage output terminals. The second level signal input terminal 16 is connected to first terminals of the fifth resistors R5, R5' and R5", and second terminals of the fifth resistors R5, R5' and R5" are connected to the pulse width modulation circuit 7. The second level signal input terminal 16 is used for generating a second initial level signal and outputting the second initial level signal to the fifth resistors R5, R5' and R5" at the same time, and the fifth resistors R5, R5' and R5" each are used for performing voltage reduction on the second initial level signal to generate a plurality of pulse-adjusting control signals. Here, resistance values of the fifth resistors R5, R5' and R5" are different from each other, and thus voltage values of the generated pulse-adjusting control signals are different.

Corresponding to the pixel units of three different colors, the number of the fifth resistors in FIG. 10 is three. Resistance values of the respective fifth resistors are different, that is, values of R5, R5' and R5" are different from each other, and therefore, the second terminals of the three fifth resistors can output three pulse-adjusting control signals with different voltage values to the pulse width modulation circuit 7 in total. Based on the received pulse-adjusting control signals with different voltage values, the pulse width modulation circuit 7 can output three initial pulse control signals with different duty ratios in total, i.e., red initial pulse control signal DR, green initial pulse control signal DG and blue initial pulse control signal DB.

In addition, the pulse control module 5 in the present embodiment may further be a single chip microcomputer, through which pulse control signals with different duty ratios can be outputted to the second switching tubes. This process is the prior art in the field, and is not described in detail herein.

Embodiment 2 of the present invention provides a driving power source, which can provide corresponding driving voltage according to colors of the pixel units to be driven, and further reduce the voltage across the driving transistor in the driving circuit of the pixel unit as compared to the voltage across the driving transistor in the prior art, thereby reducing power consumption of the driving transistor and further reducing power consumption of the display driving circuit as a whole.

Embodiment 3

Figure 11:
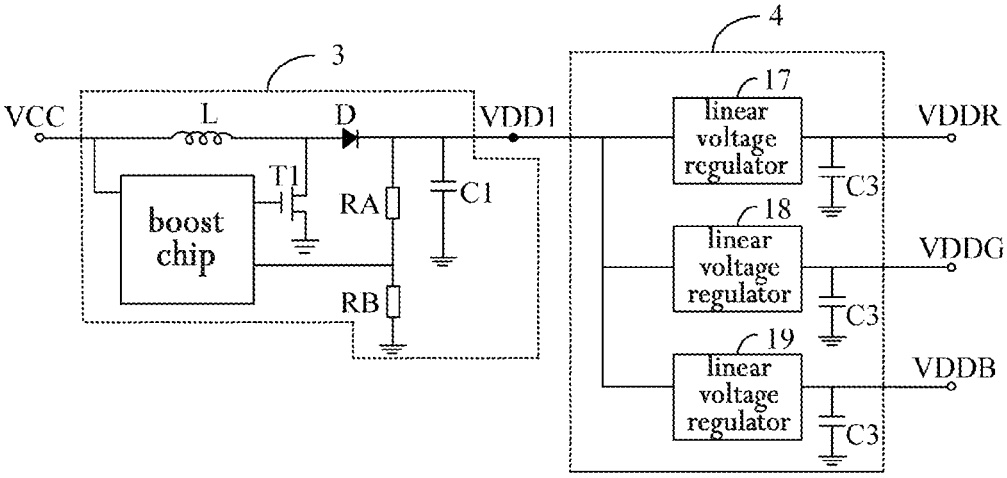
FIG. 11 is a schematic circuit diagram of a driving power supply provided by Embodiment 3 of the present invention.

FIG. 11 is a schematic circuit diagram of a driving power supply provided by Embodiment 3 of the present invention, as shown in FIG. 11, the driving power supply includes: a boost module 3 and a voltage adjusting module 4, and connection and functions of the boost module 3 and the voltage adjusting module 4 may refer to the above-described Embodiment 1. The present embodiment provide another specific structure of the driving power supply in the above-described Embodiment 1, and will be described by taking the case that there are three driving voltage output terminals in the driving power supply as an example as well. Here, the voltage adjusting module 4 includes: linear voltage regulators 17, 18 and 19 and third filter capacitors C3, the number of the linear voltage regulators 17, 18 and 19 and the number of the third filter capacitors C3 are the same as that of the driving voltage output terminals. The linear voltage regulators 17, 18 and 19 are in one-to-one correspondence with the driving voltage output terminals, the third filter capacitors C3 are in one-to-one correspondence with the driving voltage output terminals, input terminals of the linear voltage regulators are connected to the boost module 3, output terminals of the linear voltage regulators 17, 18 and 19 are connected to the driving voltage output terminals and first terminals of the third filter capacitors C3, second terminals of the third filter capacitors C3 are grounded, the linear regulators each are used for performing voltage reduction on the reference voltage VDD1 to generate the driving voltages VDDR, VDDG and VDDB, and different linear voltage regulators have different voltage reduction extents.

Since the same voltage (the reference voltage VDD1) is input to the input terminal of each of the linear voltage regulators 17, 18 and 19, and in the meanwhile, different linear voltage regulators 17, 18 and 19 have different voltage reduction extents, the three linear voltage regulators 17, 18 and 19 can output three different driving voltages, which are used for driving the pixel units of different colors, respectively.

It should be noted that, structure and working principle of the linear voltage regulator belong to the prior art in the field, and are not described in detail herein.

Embodiment 3 of the present invention provides a driving power source, which can provide corresponding driving voltage according to colors of the pixel units to be driven, and further reduce the voltage across the driving transistor in the driving circuit of the pixel unit as compared to the voltage across the driving transistor in the prior art, thereby reducing power consumption of the driving transistor and further reducing power consumption of the display driving circuit as a whole.

Embodiment 4

Embodiment 4 of the present invention provides a display driving circuit including a driving power supply, which is the driving power supply described in any one of the above Embodiments 1 to 3. Specific structure of the driving power supply may refer to the descriptions in the above Embodiments 1 to 3.

Embodiment 4 of the present invention provides a display driving circuit including the above-described driving power supply, which can provide corresponding driving voltage according to colors of the pixel units to be driven, and further reduce the voltage across the driving transistor in the driving circuit of the pixel unit as compared to the voltage across the driving transistor in the prior art, thereby reducing power consumption of the driving transistor and further reducing power consumption of the display driving circuit as a whole.

Embodiment 5

Embodiment 5 of the present invention provides an organic light-emitting diode display including a display driving circuit, which is the display driving circuit described in the above Embodiment 4.

Figure 12:
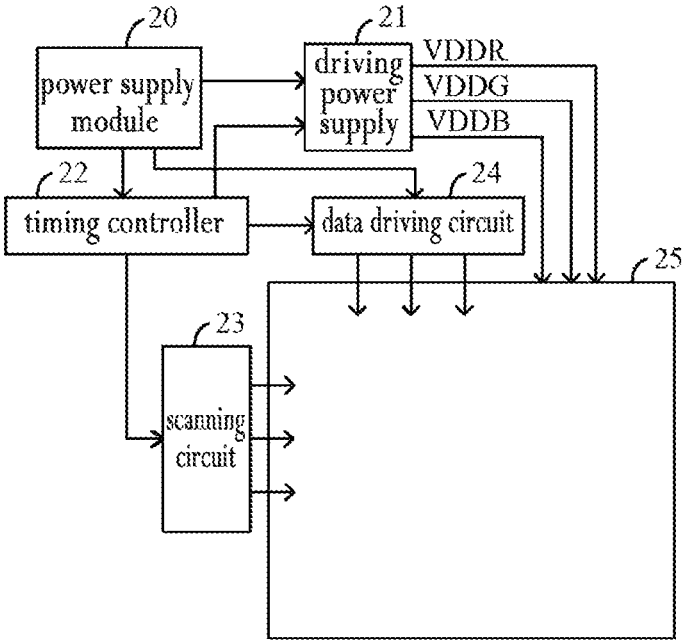
FIG. 12 is a schematic circuit diagram of an organic light emitting diode display provided by Embodiment 5 of the present invention.
Figure 13:
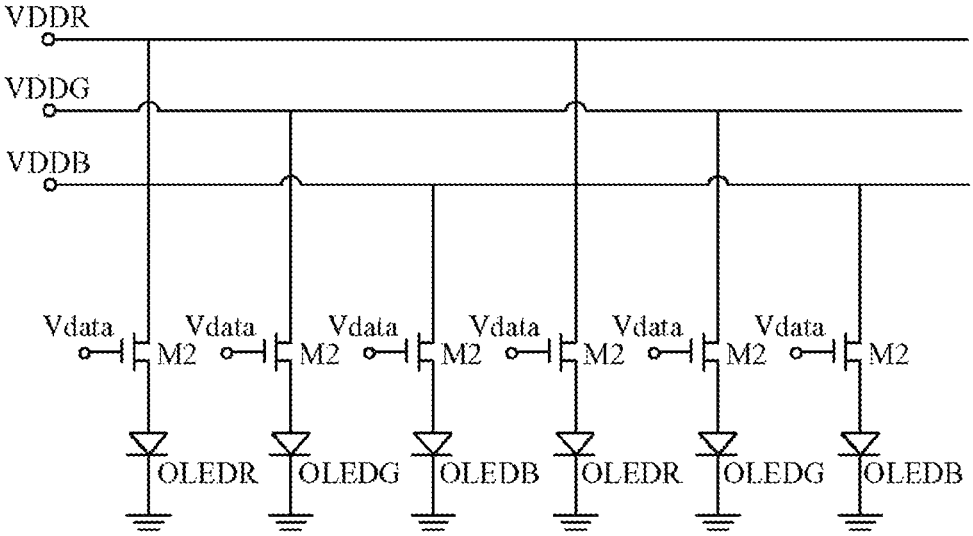
FIG. 13 is a diagram illustrating the driving principle of the organic light emitting diode display shown in FIG. 12.

FIG. 12 is a schematic circuit diagram of the organic light emitting diode display provided by Embodiment 5 of the present invention, FIG. 13 is a diagram illustrating the driving principle of the organic light emitting diode display shown in FIG. 12, and as shown in FIGS. 12 and 13, the organic light emitting diode display includes: a display panel 25, a power supply module 20, a timing controller 22, a display driving circuit, a scanning circuit 23 and a data driving circuit 24. The display panel 25 includes a plurality of pixel units, and the display driving circuit at least includes: a driving power supply 21 and a plurality of pixel unit driving circuits driven by the driving power supply 21. Each pixel unit driving circuit includes: a switching transistor M1, a driving transistor M2, a storage capacitor and light emitting devices OLEDR, OLEDG and OLEDB. The switching transistor M1, the driving transistor M2, the storage capacitor and the light emitting devices are all formed above the substrate in the display panel 25, which is not shown in FIG. 12. The power supply module 20 is connected to all of the timing controller 22, the data driving circuit 24 and the driving power supply 21, the timing controller 22 is connected to all of the driving power supply 21, the scanning circuit 23 and the data driving circuit 24, the scanning circuit 23 is connected to the gate of the switching transistor M1, and the data driving circuit 24 is connected to the source of the switching transistor M1. The driving power supply 21 can output different driving voltages to the pixel units of different colors (or, a plurality of pixel unit driving circuits) in the display panel 25. Here, the pixel units of the same color correspond to driving voltages of the same magnitude, and the pixel units of different colors correspond to driving voltages of different magnitudes.

It is assumed that the pixel units in the present embodiment include: red pixel units (each including red organic electroluminescent device OLEDR), green pixel units (each including green organic electroluminescent device OLEDG)

and blue pixel units (each including blue organic electroluminescent device OLEDB). Corresponding to the pixel units of three different colors, the driving power supply 21 can provide three different driving voltages, which are respectively: red driving voltage VDDR, green driving voltage VDDG and blue driving voltage VDDB, and magnitudes of VDDR, VDDG and VDDB satisfy relationship of VDDG<VDDR<VDDB. The red driving voltage VDDR is used for driving the red pixel units, the green driving voltage VDDG is used for driving the green pixel units, and the blue driving voltage VDDB is used for driving the blue pixel units. In this way, the heating phenomenon of the driving transistors in a part of pixel units when the pixel units of different colors are driven by the driving voltage of the same magnitude in the prior art can be avoided.

In the present embodiment, optionally, the power supply module 20 may be integrated with the driving power supply 21 in the same module, and the power supply module 20 is used for providing an initial voltage VCC to the driving power supply 21.

In the present embodiment, structures and working principles of the timing controller 22, the power supply module 20, the scanning circuit 23 and the data driving circuit 24 are the same as those in the prior art, and are not described repeatedly herein.

Embodiment 5 of the present invention provides an organic light emitting diode display including the above-described display driving circuit, which can effectively reduce gate-source voltage of the driving transistor in the pixel unit when it is operating, thereby avoiding heating in the driving transistor, reducing power consumption of the driving transistor at the same time, and further lowering power consumption of the organic light emitting diode display as a whole.

It should be noted that, the pixel units in the above embodiments include: red pixel units, green pixel units and blue pixel units, and the technical solution, in which the number of the driving voltage output terminals of the driving power supply is three, is merely exemplary, and is not meant to limit the technical solutions of the present application.

It can be understood that, the above implementations are merely exemplary implementations used for explaining the principle of the present invention, but the present invention is not limited thereto. For those skilled in the art, various modifications and improvements may be made without departing from the spirit and essence of the present invention, and these modifications and improvements are also deemed as falling within the protection scope of the present invention.

The invention claimed is:

1. A driving power supply, comprising a boost module and a voltage adjusting module connected to the boost module, wherein, the boost module is used for boosting an initial voltage input from an initial voltage input terminal of the driving power supply to generate a reference voltage and for outputting the reference voltage to the voltage adjusting module;

the voltage adjusting module is used for adjusting magnitude of the reference voltage according to colors of pixel units to be driven to generate a plurality of driving voltages, respectively, wherein, the driving voltages corresponding to pixel units of different colors are different, the plurality of driving voltages are outputted through a plurality of driving voltage output terminals of the voltage adjusting module, respectively, and each of the plurality of driving voltage output terminals is used for driving pixel units of one color, and different driving voltage output terminals output different driving voltages, and the voltage adjusting module comprises a pulse control module used for generating pulse control signals, and a duty ratio of each pulse control signal is related to the reference voltage.

2. The driving power supply according to claim 1, wherein, the voltage adjusting module comprises: second switching tubes and second filter capacitors, the number of the second switching tubes and the number of the second filter capacitors are equal to that of the driving voltage output terminals, the second switching tubes are in one-to-one correspondence with the driving voltage output terminals, and the second filter capacitors are in one-to-one correspondence with the driving voltage output terminals;

gates of the second switching tubes are connected to the pulse control module, first electrodes of the second switching tubes are connected to the boost module, second electrodes of the second switching tubes are connected to the corresponding driving voltage output terminals and first terminals of the second filter capacitors;

second terminals of the second filter capacitors are grounded; and the pulse control module is used for sending the pulse control signals to the second switching tubes, respectively, and the duty ratio of each pulse control signal equals to a ratio between the driving voltage output from the driving voltage output terminal connected to the second switching tube which receives said pulse control signal and the reference voltage.

3. The driving power supply according to claim 2, wherein, the pulse control module comprises: a pulse-adjusting control sub-module, a pulse generator, a pulse width modulation circuit and a level conversion circuit, and the pulse width modulation circuit is connected to all of the pulse-adjusting control sub-module, the pulse generator and the level conversion circuit;

the pulse-adjusting control sub-module is used for generating a plurality of pulse-adjusting control signals according to the reference voltage and the driving voltages to be generated by the voltage adjusting module;

the pulse generator is used for generating an initial pulse signal with a preset frequency;

the pulse width modulation circuit is used for performing pulse width modulation on the initial pulse signal according to the respective pulse-adjusting control signals, so as to generate a plurality of initial pulse control signals; and the level conversion circuit is used for performing level conversion on the initial pulse control signals so as to generate a plurality of pulse control signals, which are used for controlling on/off states of the second switching tubes, respectively.

4. The driving power supply according to claim 3, wherein, the pulse-adjusting control sub-module comprises: a storage device and a decoding circuit connected to both the storage device and the pulse width modulation circuit;

the storage device stores data information of the reference voltage and data information of the driving voltages to be generated by the voltage adjusting module; and the decoding circuit is used for performing a decoding process on the data information of the reference voltage and the data information of the driving voltages to be generated by the voltage adjusting module, so as to obtain voltage values of the reference voltage and the driving voltages to be generated by the voltage adjusting module, and the decoding circuit is further used for generating pulse-adjusting control signals according to ratios between the voltage values of the driving voltages to be generated by the voltage adjusting module and the voltage value of the reference voltage.

5. The driving power supply according to claim 4, wherein, the storage device is a read-only memory, which pre-stores data information of the driving voltages corresponding to the pixel units of different colors and the data information of the reference voltage.

6. The driving power supply according to claim 4, wherein, the storage device is a register, and the pulse-adjusting control sub-module further comprises: a signal receiver, which is connected to the decoding circuit;

the signal receiver is used for receiving a timing control signal sent by a timing controller outside the driving power supply, and the timing control signal includes the data information of the reference voltage and the data information of the driving voltages to be generated by the voltage adjusting module; and the decoding circuit is further used for decoding the timing control signal to obtain the data information of the reference voltage and the data information of the driving voltages to be generated by the voltage adjusting module therein, and storing the decoded data information of the reference voltage and the decoded data information of the driving voltages to be generated by the voltage adjusting module into the register.

7. The driving power supply according to claim 3, wherein, the pulse-adjusting control sub-module comprises: a first level signal input terminal and groups of divider resistors whose number is the same as that of the driving voltage output terminals, and each group of divider resistors comprises: a third resistor and a fourth resistor connected in series;

the first level signal input terminal is connected to first terminals of the third resistors, second terminals of the fourth resistors are grounded, second terminals of the third resistors and first terminals of the fourth resistors are connected to the pulse width modulation circuit;

the first level signal input terminal is used for generating a first initial level signal and outputting the first initial level signal to the groups of divider resistors;

the groups of divider resistors each are used for performing voltage dividing process on the first initial level signal to generate the pulse-adjusting control signals; and ratios between resistance values of the third resistors and resistance values of the fourth resistors in different groups of divider resistors are different.

8. The driving power supply according to claim 3, wherein, the pulse-adjusting control sub-module comprises: a second level signal input terminal and fifth resistors whose number is the same as that of the driving voltage output terminals, the second level signal input terminal is connected to first terminals of the fifth resistors, and second terminals of the fifth resistors are connected to the pulse width modulation circuit;

the second level signal input terminal is used for generating a second initial level signal and outputting the second initial level signal to the fifth resistors;

the fifth resistors each are used for performing voltage reduction on the second initial level signal to generate the pulse-adjusting control signals; and resistance values of the fifth resistors are different from each other.

9. The driving power supply according to claim 2, wherein, the pixel units include: red pixel units, green pixel units and blue pixel units, and the number of the driving voltage output terminals is three.

10. The driving power supply according to claim 9, wherein, the pulse control signals include: red pulse control signal, green pulse control signal and blue pulse control signal;

phase differences between a rising edge of any one of the red pulse control signal, the green pulse control signal and the blue pulse control signal and rising edges of the other two pulse control signals are both 120 degrees; or, phase differences between a falling edge of any one of the red pulse control signal, the green pulse control signal and the blue pulse control signal and falling edges of the other two pulse control signals are both 120 degrees.

11. The driving power supply according to claim 2, wherein, the pulse control module is a single chip microcomputer.

12. The driving power supply according to claim 1, wherein, the voltage adjusting module comprises: linear voltage regulators and third filter capacitors, the number of the linear voltage regulators and the number of the third filter capacitors are the same as that of the driving voltage output terminals, the linear voltage regulators are in one-to-one correspondence with the driving voltage output terminals, and the third filter capacitors are in one-to-one correspondence with the driving voltage output terminals;

input terminals of the linear voltage regulators are connected to the boost module, and output terminals of the linear voltage regulators are connected to the driving voltage output terminals and first terminals of the third filter capacitors;

second terminals of the third filter capacitors are grounded;

the linear regulators each are used for performing voltage reduction on the reference voltage to generate the driving voltages; and different linear voltage regulators have different voltage reduction extents.

13. A display driving circuit, comprising: the driving power supply according to claim 1.

14. The display driving circuit according to claim 13, wherein, the voltage adjusting module comprises: second switching tubes and second filter capacitors, the number of the second switching tubes and the number of the second filter capacitors are equal to that of the driving voltage output terminals, the second switching tubes are in one-to-one correspondence with the driving voltage output terminals, and the second filter capacitors are in one-to-one correspondence with the driving voltage output terminals;

gates of the second switching tubes are connected to the pulse control module, first electrodes of the second switching tubes are connected to the boost module, second electrodes of the second switching tubes are connected to the corresponding driving voltage output terminals and first terminals of the second filter capacitors;

second terminals of the second filter capacitors are grounded; and the pulse control module is used for sending the pulse control signals to the second switching tubes, respectively, and the duty ratio of each pulse control signal equals to a ratio between the driving voltage output from the driving voltage output terminal connected to the second switching tube which receives said pulse control signal and the reference voltage.

15. The display driving circuit according to claim 14, wherein, the pulse control module comprises: a pulse-adjusting control sub-module, a pulse generator, a pulse width modulation circuit and a level conversion circuit, and the pulse width modulation circuit is connected to all of the pulse-adjusting control sub-module, the pulse generator and the level conversion circuit;

the pulse-adjusting control sub-module is used for generating a plurality of pulse-adjusting control signals according to the reference voltage and the driving voltages to be generated by the voltage adjusting module;

the pulse generator is used for generating an initial pulse signal with a preset frequency;

the pulse width modulation circuit is used for performing pulse width modulation on the initial pulse signal according to the respective pulse-adjusting control signals, so as to generate a plurality of initial pulse control signals; and the level conversion circuit is used for performing level conversion on the initial pulse control signals so as to generate a plurality of pulse control signals, which are used for controlling on/off states of the second switching tubes, respectively.

16. The display driving circuit according to claim 15, wherein, the pulse-adjusting control sub-module comprises: a storage device and a decoding circuit connected to both the storage device and the pulse width modulation circuit;

the storage device stores data information of the reference voltage and data information of the driving voltages to be generated by the voltage adjusting module; and the decoding circuit is used for performing a decoding process on the data information of the reference voltage and the data information of the driving voltages to be generated by the voltage adjusting module, so as to obtain voltage values of the reference voltage and the driving voltages to be generated by the voltage adjusting module, and the decoding circuit is further used for generating pulse-adjusting control signals according to ratios between the voltage values of the driving voltages to be generated by the voltage adjusting module and the voltage value of the reference voltage.

17. The display driving circuit according to claim 13, wherein, the voltage adjusting module comprises: linear voltage regulators and third filter capacitors, the number of the linear voltage regulators and the number of the third filter capacitors are the same as that of the driving voltage output terminals, the linear voltage regulators are in one-to-one correspondence with the driving voltage output terminals, and the third filter capacitors are in one-to-one correspondence with the driving voltage output terminals;

input terminals of the linear voltage regulators are connected to the boost module, and output terminals of the linear voltage regulators are connected to the driving voltage output terminals and first terminals of the third filter capacitors;

second terminals of the third filter capacitors are grounded;

the linear regulators each are used for performing voltage reduction on the reference voltage to generate the driving voltages; and different linear voltage regulators have different voltage reduction extents.

18. An organic light emitting diode display, comprising: the display driving circuit according to claim 13.

* * * * *